US009571935B2

(12) United States Patent
Moro

(10) Patent No.: US 9,571,935 B2
(45) Date of Patent: Feb. 14, 2017

(54) LOUDSPEAKER WITH DUCTS FOR TRANSDUCER VOICE COIL COOLING

(71) Applicant: Harman International Industries, Inc., Stamford, CT (US)

(72) Inventor: Jerry Moro, Moorpark, CA (US)

(73) Assignee: Harman International Industries, Inc., Stamford, CT (US)

( * ) Notice: Subject to any disclaimer, the term of this patent is extended or adjusted under 35 U.S.C. 154(b) by 60 days.

(21) Appl. No.: 14/605,129

(22) Filed: Jan. 26, 2015

(65) Prior Publication Data

US 2016/0219370 A1 Jul. 28, 2016

(51) Int. Cl.

| | |
|---|---|
| ***H04R 11/02*** | (2006.01) |
| ***H04R 9/02*** | (2006.01) |
| ***H04R 9/06*** | (2006.01) |

(52) U.S. Cl.

CPC ..... *H04R 9/022* (2013.01); *H04R 9/027* (2013.01); *H04R 9/06* (2013.01); *H04R 2209/041* (2013.01)

(58) Field of Classification Search

CPC ..... H04R 25/00; A61F 11/06; G10K 11/16; H03B 29/00

USPC ..... 381/397, 419, 420, 412, 430, 396, 400,381/407, 433, 192, 199; 310/12, 15, 17, 190; 29/594

See application file for complete search history.

(56) References Cited

U.S. PATENT DOCUMENTS

| | | | | |
|---|---|---|---|---|
| 4,042,193 | A * | 8/1977 | Cerne | B64C 1/1407 192/144 |
| 5,179,595 | A * | 1/1993 | Pollet | H04R 9/045 381/114 |
| 5,721,401 | A * | 2/1998 | Sim | H04R 1/345 181/148 |
| 5,940,522 | A | 8/1999 | Cahill et al. | |
| 6,243,479 | B1 | 6/2001 | Proni | |
| 6,373,957 | B1 | 4/2002 | Stewart | |
| 6,639,993 | B2 * | 10/2003 | Kemmerer | H04R 9/025 381/397 |
| 7,711,134 | B2 | 5/2010 | Stead et al. | |
| 7,831,059 | B1 * | 11/2010 | Sahyoun | H04R 9/022 381/396 |
| 8,204,269 | B2 | 6/2012 | Sahyoun | |

(Continued)

OTHER PUBLICATIONS

US Office Action for U.S. Appl. No. 14/605,111, mailed Jul. 28, 2016, 15 pages.

*Primary Examiner* — Md S Elahee
*Assistant Examiner* — Julie X Dang
(74) *Attorney, Agent, or Firm* — Brooks Kushman P.C.

(57) ABSTRACT

A loudspeaker includes a motor assembly having a back plate and a pole piece centrally disposed with respect to the back plate. The pole piece has a first end and a second end, where the pole piece has a center vent allowing bi-directional air flow in and out of the motor assembly. The motor assembly further includes a top plate concentrically disposed with respect to the pole piece, and a magnet disposed between the back plate and the top plate, wherein a magnetic air gap is defined between the pole piece and the top plate. The loudspeaker further includes a voice coil disposed in the air gap. The pole piece includes at least one NACA duct formed therein, the at least one NACA duct having an inlet located at an internal surface of the pole piece in fluid communication with the center vent and an outlet located at an exterior surface of the pole piece in fluid communication with the magnetic air gap in order to extract air flow from the center vent and redirect the air flow toward the voice coil.

20 Claims, 8 Drawing Sheets

(56) References Cited

U.S. PATENT DOCUMENTS

| | | | | |
|---|---|---|---|---|
| 2004/0131219 | A1 | 7/2004 | Polk, Jr. | |
| 2005/0058315 | A1 | 3/2005 | Poling et al. | |
| 2005/0094837 | A1 | 5/2005 | Parker et al. | |
| 2005/0265570 | A1* | 12/2005 | Isotalo | H04R 1/30 381/337 |
| 2007/0154056 | A1* | 7/2007 | Proni | H04R 9/022 381/396 |
| 2012/0033843 | A1 | 2/2012 | Ouweltjes et al. | |

* cited by examiner

LOUDSPEAKER WITH DUCTS FOR TRANSDUCER VOICE COIL COOLING

TECHNICAL FIELD

Embodiments relate to loudspeakers with ducts for transducer voice coil cooling.

BACKGROUND

In a typical loudspeaker system, the motor assembly includes a permanent magnet mounted between a top plate and a back plate, a pole piece centrally mounted on the back plate, and a voice coil axially movable with respect to the pole piece. During operation of the loudspeaker, electrical energy is supplied to the voice coil, causing the voice coil and attached diaphragm to move axially relative to the pole piece and within the air gap formed between the top plate and the pole piece. Heat produced by the voice coil can build up and be radiated to surrounding surfaces, particularly the top plate and pole piece. Eventually, this increasing voice coil temperature will lead to reduced power handling of the speaker and increased power compression.

The pole piece may be formed with a center vent which provides a flow path for the transfer of cooling air from outside of the speaker. Air flow through this vent is created in response to movement of the diaphragm with the excursion of the voice coil. However, such designs do little to directly cool the transducer voice coil, as air is simply pumped straight through the pole piece out the back of the motor. In fact, in some cases, a very large center vent can reduce convective cooling in proximity of the voice coil, and therefore reducing power handling of the loudspeaker system.

In some instances, holes or slots may be formed radially within the pole piece and extend outwardly from the center vent toward the voice coil in an attempt to provide convective cooling to the voice coil. Such radial holes may be effective to cause cooling air from the center vent to flow directly against at least a portion of the voice coil, but the position and shape of these holes or slots does not efficiently pull toward the voice coil and disturbs the laminar air flow within the center vent, creating turbulence and drag. Furthermore, an acoustic problem can be created with such radial slots, as a large amount of air is forced through a small passage.

SUMMARY

In one embodiment, a loudspeaker comprises a motor assembly including a back plate, a pole piece centrally disposed with respect to the back plate, the pole piece having a first end and a second end, where the pole piece has a center vent allowing bi-directional air flow in and out of the motor assembly. The motor assembly further includes a top plate concentrically disposed with respect to the pole piece, and a magnet disposed between the back plate and the top plate, wherein a magnetic air gap is defined between the pole piece and the top plate. The loudspeaker further includes a voice coil disposed in the air gap. The pole piece includes at least one NACA duct formed therein, the at least one NACA duct having an inlet located at an internal surface of the pole piece in fluid communication with the center vent and an outlet located at an exterior surface of the pole piece in fluid communication with the magnetic air gap in order to extract air flow from the center vent and redirect the air flow toward the voice coil.

In another embodiment, a loudspeaker comprises a motor assembly including a back plate, a pole piece centrally disposed with respect to the back plate, the pole piece having a first end and a second end, where the pole piece has a center vent and having at least one aperture formed therein. The motor assembly further includes a top plate concentrically disposed with respect to the pole piece, and a magnet disposed between the back plate and the top plate, wherein a magnetic air gap is defined between the pole piece and the top plate. The loudspeaker further includes a voice coil disposed in the air gap, and a hollow insert member arranged to be received within the center vent and allowing bi-directional air flow in and out of the motor assembly. The insert member has a first end and a second end, and includes at least one duct formed therein having an inlet located at an interior surface of the insert member and an outlet located at an exterior surface of the insert member. Alignment of the duct outlet with the at least one aperture of the pole piece allows for fluid communication between insert member and the air gap to extract air flow from the insert member and redirect the air flow toward the voice coil.

In another embodiment, a loudspeaker comprises a motor assembly including spaced upper and lower plates with a magnet disposed therebetween. The motor assembly further includes a motor support housing supporting the lower plate and an inner sleeve supported by the motor support housing, the inner sleeve having apertures formed therein. First and second magnetic air gaps of opposite polarity are defined by the inner sleeve on one side and by the upper plate and the lower plate on another side. The loudspeaker further includes a first voice coil disposed in the first air gap, and a second voice coil disposed in the second air gap and spaced from the first voice coil. At least one hollow insert member arranged to be received by the motor support housing and allowing bi-directional air flow in and out of the motor assembly, the at least one insert member including NACA ducts formed therein each having an inlet located at an interior surface of the insert member and an outlet located at an exterior surface of the insert member, wherein alignment of the duct outlets with the apertures of the inner sleeve allows for fluid communication between the insert member and the first and second air gaps to extract air flow from the insert member and redirect the air flow toward the first and second voice coils.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
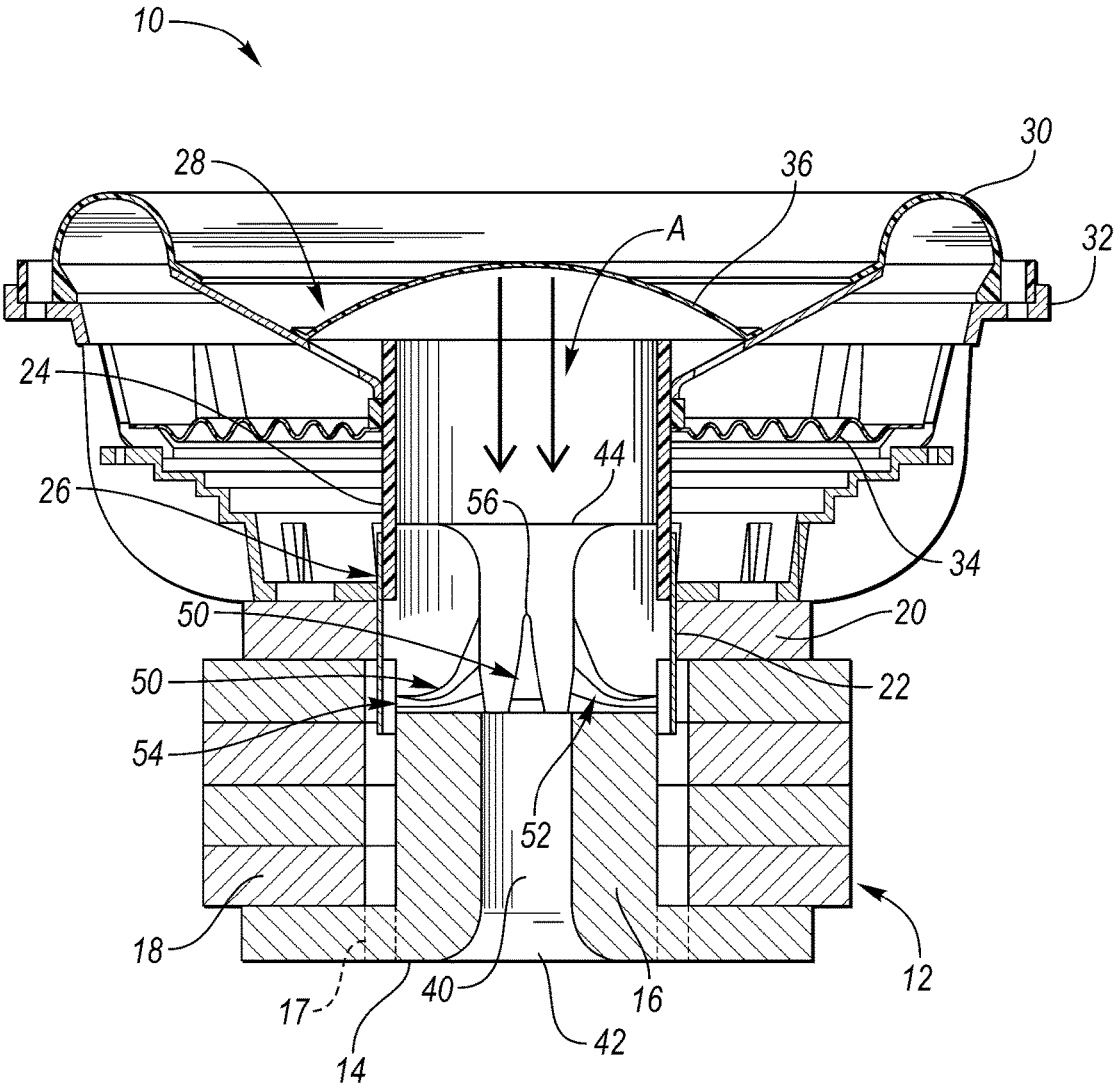
FIG. 1 is a front, partially cross-sectional view of a loudspeaker according to an embodiment having ducts formed in the same direction in the pole piece.

With reference to the cross-sectional view of FIG. 1, a loudspeaker or transducer 10 may include a motor assembly 12 having a back plate 14 and a pole piece 16 centrally disposed with respect to the back plate 14, a permanent magnet 18, and a front or top plate 20 concentrically disposed with respect to the pole piece 16, wherein the motor assembly 12 may provide a substantially uniform magnetic field across an air gap 22. A voice coil former 24 may support a voice coil 26 in the air gap 22. The loudspeaker 10 may also include a diaphragm or cone 28, wherein a portion of the diaphragm 28 may be coupled with an end of the voice coil former 24. An outer end of the diaphragm 28 may be coupled to a surround 30 which, in turn, may be coupled at an outer perimeter to a frame or basket 32. A spider 34 may be coupled to the basket 32 and may include a central opening to which the voice coil former 24 is coupled. In other examples, the diaphragm 28 may be coupled with the voice coil former 24 via the spider 34 or any other component of the loudspeaker 10. In addition, the loudspeaker 10 may include a center cap or dust dome 36 that is designed to keep dust or other particulars out of the motor assembly 12.

As is known in the art, the loudspeaker 10 may be mounted within an enclosure (not shown), and a loudspeaker system may also include additional internal components within the enclosure such as, but not limited to, an amplifier (not shown). During operation, current from the amplifier or some other device supplying electrical signals representing program material to be transduced by the loudspeaker 10 may drive the voice coil 26. Axial reciprocation of the voice coil 26 in the air gap 22 in connection with the diaphragm 28 generates sound representing the program material transduced by the loudspeaker 10. Other speaker components may alternatively or additionally be included in the loudspeaker system.

Figure 2:
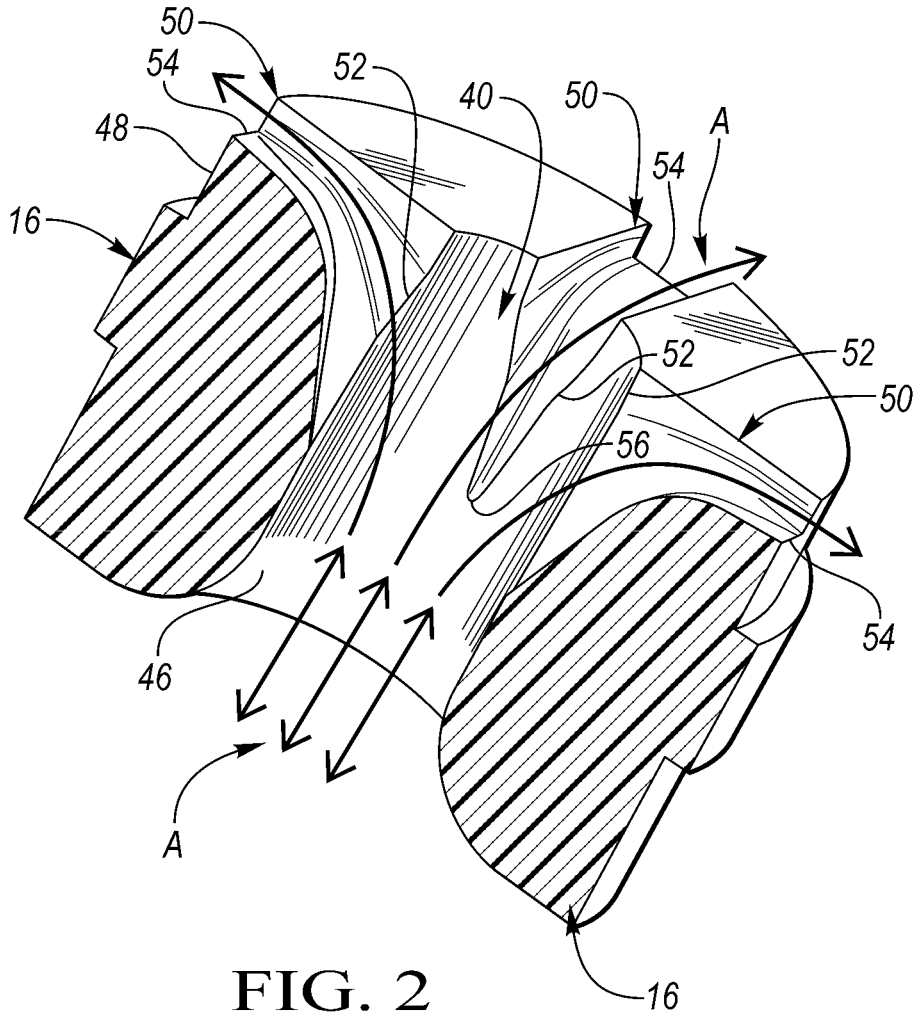
FIG. 2 is a perspective, cross-sectional view of a portion of the pole piece illustrating the ducts and the airflow therethrough.

With reference to FIGS. 1 and 2, the pole piece 16 includes a center vent 40 which is a source of high velocity, bi-directional air flow in and out of the pole first end 42 and the pole second end 44, as indicated by the arrows A in FIGS. 1 and 2. As shown, one or more ducts 50 may be provided within the pole piece 16 for directing air flowing in and out of the center vent 40 via the diaphragm 28 and dome 36 along a flow path which is in fluid communication with the air gap 22 and voice coil 26. Each duct 50 has an inlet 52 located at an internal surface 46 of the pole piece 16, in fluid communication with the center vent 40, and an outlet 54 located on an exterior surface 48 of the pole piece 16, in fluid communication with the air gap 22. As described below, these ducts 50 direct air flow towards the inner diameter of the voice coil 26 without disrupting the flow of air in the center vent 40. This air flow aimed at the voice coil 26 increases the convective cooling, thus lowering the temperature of the voice coil 26.

In one embodiment, the ducts 50 may comprise NACA ducts, also known as NACA (National Advisory Committee for Aeronautics) scoops or submerged inlets. NACA ducts may be used to extract air at the surface inlet with minimal disruption to laminar air flow and coefficient of drag. As is known in the art, a NACA submerged inlet duct utilizes a special geometry from a front to a rear of the duct which improves the pressure recovery, wherein an optimum NACA duct design employs curved diverging ramp walls with a width to depth ratio between about 3 and 5, and a ramp angle of between about 5 and 7 degrees. In one embodiment, an entrance lip at the back of the duct may have a blunt airfoil leading edge shape. Since NACA ducts can extract air with minimal disturbance of air flowing through the center vent 40, these ducts will contribute very little in the way of extraneous noises or distortions to the loudspeaker 10.

The specific divergent geometry of the NACA duct scavenges boundary-layer air from the air flowing in the center vent 40 related to the AC displacement of the transducer diaphragm 28 and dome 36, and directs the air toward the voice coil 26 which may benefit from or require direct forced air cooling, thus improving power handling and output. NACA ducts may operate by scavenging slower moving air at the surface, while greatly minimizing turbulence and drag at the inlet. In doing so, the NACA duct does not disturb the laminar flow of the passing air. The length and shape of the NACA duct may also create counter-rotating vortices that deflect the boundary layer away from the inlet but draw in the fast moving air above it. The carefully optimized dimensions and divergent side wall and sloped floor geometry of the NACA duct allow it to work with the boundary layer of slower moving air and direct it towards the duct outlet. In any event, the NACA duct is efficiently diverting air flow out of the center vent 40 with minimal impact to air flow therein.

Although NACA-type ducts are shown and described herein, it is understood that other duct configurations which extract air flow from the center vent 40 and direct the air flow toward the air gap 22 and voice coil 26 are also fully contemplated.

One or more ducts 50 can be used depending on the application and how much air flow or cooling is desired. In the embodiment depicted in FIGS. 1 and 2, diametrically opposed first and second pairs of NACA ducts (i.e., 4 spaced ducts) may be used and cover four quadrants of the voice coil 26 for good convection cooling distribution. As illustrated, the ducts may be equally spaced along the interior surface 46 of the pole piece 16 for approximately even distribution of air flow. However, this illustrated placement is not intended to be limiting and the ducts 50 may disposed at other locations on the pole piece 16. The number of ducts is also merely exemplary, and other configurations and locations of ducts 50 are also contemplated. In one embodiment, holes 17 may be provided in the back plate 14 to allow hot air within the magnetic air gap 22 to escape and be exchanged with outside air, offering additional cooling.

Figure 3:
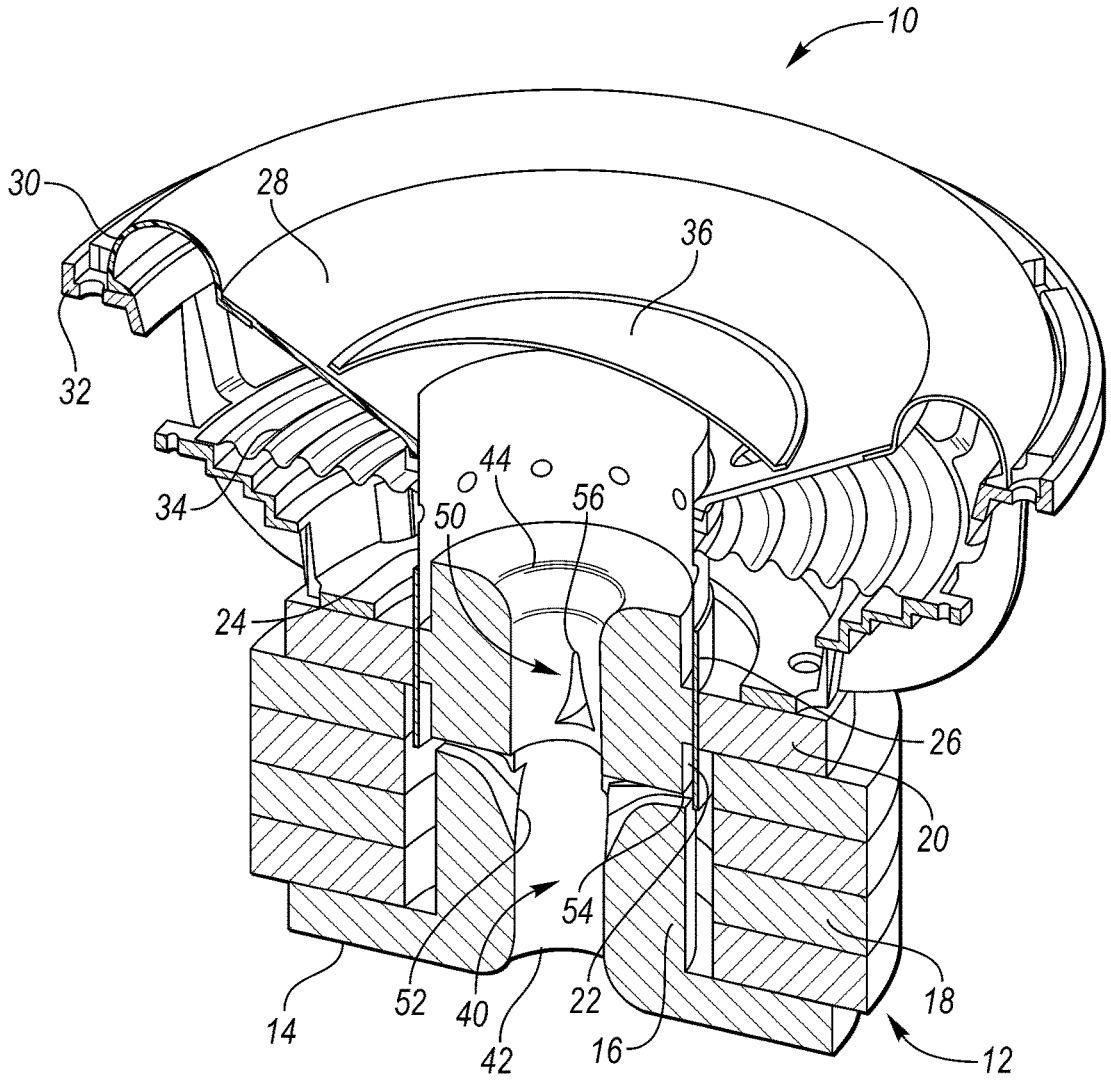
FIG. 3 is a perspective, cross-sectional view of a loudspeaker according to an embodiment having a uniform diameter center vent and pole ducts formed in alternating directions.
Figure 4:
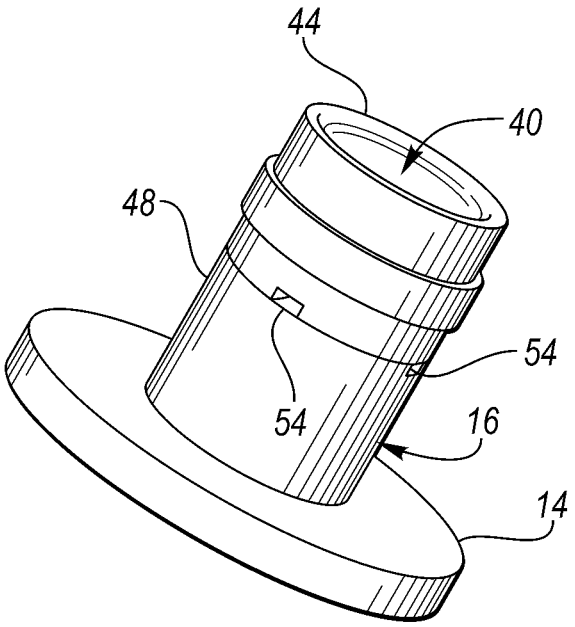
FIG. 4 is a perspective view of a pole piece according to an embodiment illustrating the duct exits for ducts with alternating directions.
Figure 5:
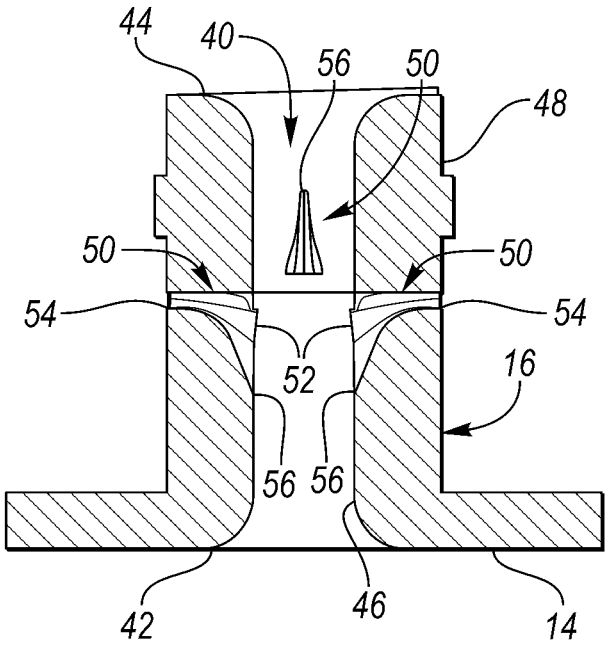
FIG. 5 is a cross-sectional view of the pole piece of FIG. 4.

In the configuration of FIGS. 1 and 2, all the NACA ducts 50 are oriented with divergent geometry in the same direction. This means that the ducts will extract the air flowing in the center vent 40 in only one direction (e.g., diaphragm 28/dome 36 moving inwards towards motor assembly 12). In other words, only one-half cycle of diaphragm 28/dome 36 AC motion will pump air towards the voice coil 26. To offer a more steady convection cooling air-stream at the voice coil 26, some NACA ducts 50 may be placed with the divergent geometry of their inlets 52 oriented in alternating, opposite or mirror image directions (i.e., rotated 180 degrees) relative to one another. For example, as depicted in FIGS. 3-5, two of the opposing NACA ducts 50 could have this alternate orientation, allowing two NACA ducts 50 to cool on forward diaphragm 28/dome 36 displacement and two NACA ducts 50 to cool on rearward diaphragm 28/dome 36 motion. FIG. 4 illustrates the staggered, alternating location of the duct exits 54 along the length of the pole piece 16. As best shown in the cross-sectional views of FIGS. 3 and 5, the opposing configuration of the ducts 50 may include the duct fronts 56 of two of the ducts 50 oriented toward the pole piece first end 42, and the duct fronts 56 of the other two ducts 50 oriented toward the pole piece second end 44. This arrangement may offer a more continuous forced air stream for convective cooling of the voice coil 26. Of course, other configurations and orientations of the ducts 50 are also contemplated.

In addition, the ducts 50 may be disposed at different positions along the length of the pole piece 16. In one embodiment, the ducts 50 may be equally spaced from the pole piece first end 42 and the pole piece second end 44. In another embodiment, the ducts 50 may be positioned such that some duct outlets 54 are at an upper portion of the voice coil 26, above the air gap 22, and other duct outlets 54 are at a lower portion of the voice coil 26, below the air gap 22, which may provide additional cooling benefit. In another embodiment, the ducts 50 may be disposed on a raised portion of the interior surface 46 of the pole piece 16 so that the duct inlet 52 is above the boundary layer, which may increase the pressure recovery or air flow. This may be done by placing the duct 50 on a slightly raised contour or bump that protrudes above the pole piece interior surface 46.

Figure 6:
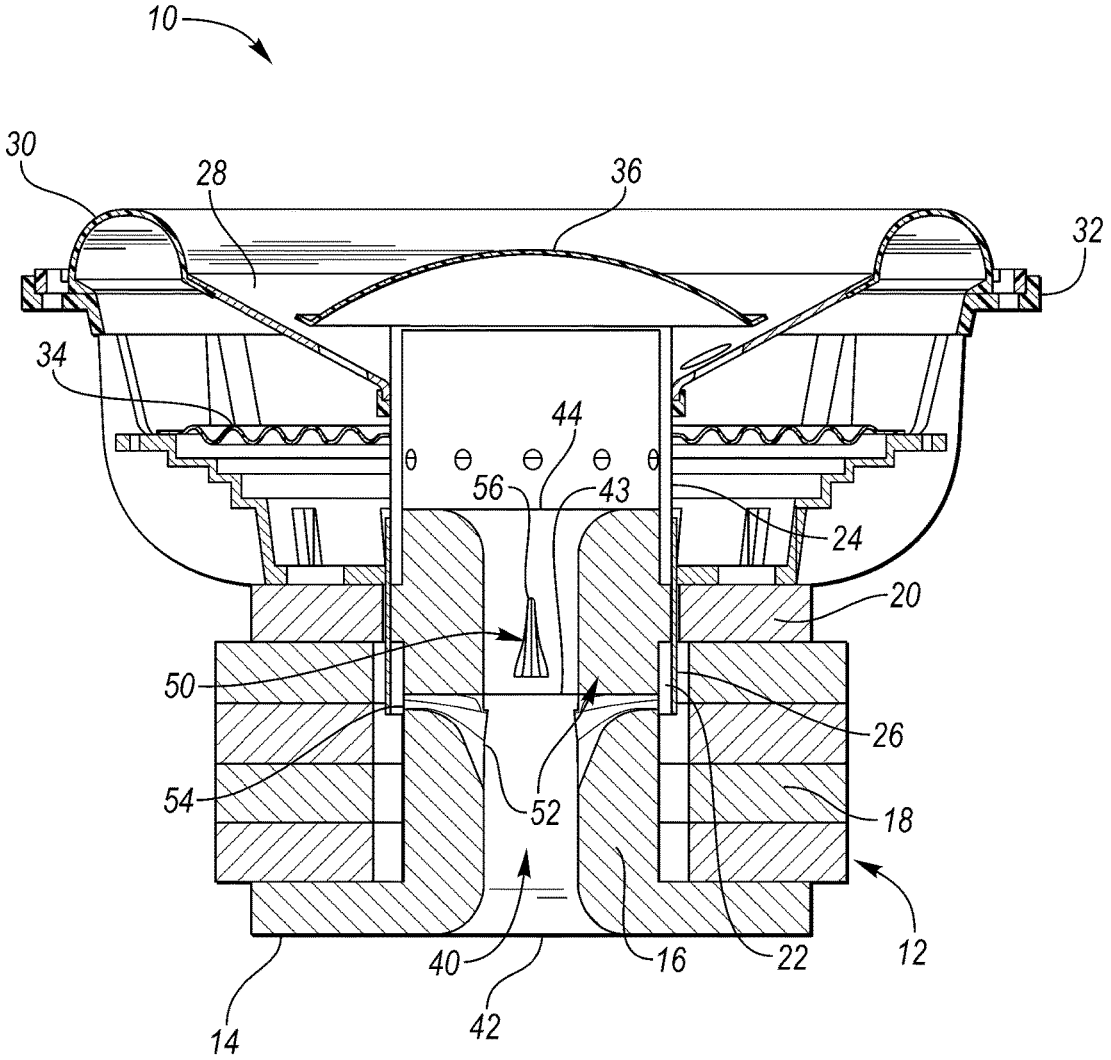
FIG. 6 is a cross-sectional view of a loudspeaker according to an embodiment having a tapered center vent and pole ducts formed in alternating directions.

As shown in the embodiments of FIGS. 1-2 and 3-5, the pole piece 16 may have a uniform configuration, with the center vent 40 having a uniform diameter along the length of the pole piece 16. However, it is understood that the pole piece 16 is not limited to this geometry. For example, as illustrated in FIG. 6, the pole piece 16 may alternatively have an angled or flared configuration, diverging from a central portion 43 of the pole piece 16 along the length of the pole piece 16 such that the center vent 40 at the pole piece first end 42 and the pole piece second end 44 has a greater diameter or cross-sectional area than does the center vent 40 at the central portion 43 of the pole piece 16. Tapered walls within the center vent 40 should generate a higher pressure gradient at the interior surface 46 of the pole piece 16, thus improving the air extraction to the voice coil 26. In this instance, the ducts 50 may be placed on a sloping surface of the flared vent, creating a positive pressure gradient near the duct inlet 52 and thus improving its operation.

In the embodiments depicted in FIGS. 1-6, the ducts 50 are integrally formed into the raw material of the pole piece 16, typically steel. With reference now to FIGS. 7-10, instead of being formed in the pole piece 16, in another embodiment an insert member 60 may be provided which includes the ducts 50, which may be NACA ducts, formed therein. While the pole piece 16 is made of steel to pass magnetic flux, the insert member 60 can be manufactured from an alternate material, such as a high temperature plastic material, metal casting such as aluminum or magnesium, or other suitable non-ferrous material. The insert member 60 may have a hollow, generally cylindrical configuration, with an interior surface 62 and an exterior surface 64 and a first end 61 and a second end 63, wherein the insert member 60 is sized and arranged to be received within the center vent 40 of the pole piece 16, allowing bi-directional air flow in and out of the motor assembly 12.

As with the embodiments of the center vent 40 described above, the interior surface 62 of the insert member 60 may have a uniform diameter along the length of the insert member 60 (e.g., as in the center vent embodiment of FIG. 3), or the interior surface 62 may alternatively have an angled or flared configuration, diverging from a central portion 65 along the length of the insert member 60 such that the insert member interior surface 62 has a greater diameter at the insert member first end 61 and the insert member second end 63 compared with a diameter of the insert member interior surface 62 at the central portion 65 of the insert member 60 (e.g., as in the center vent embodiment of FIG. 6).

Figure 7:
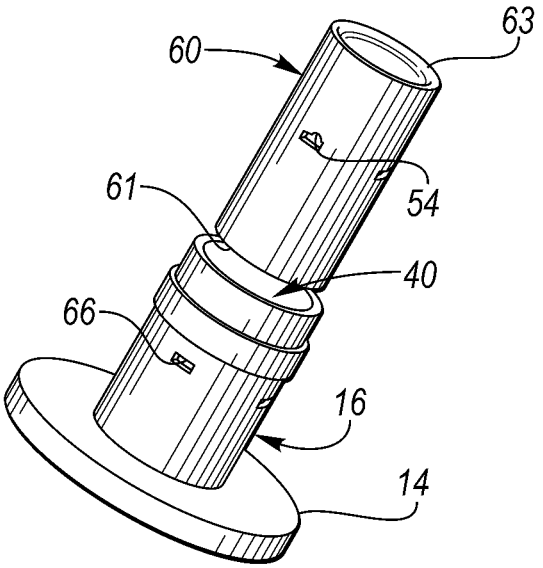
FIG. 7 is a perspective view of a pole piece and insert member prior to assembly.
Figure 8:
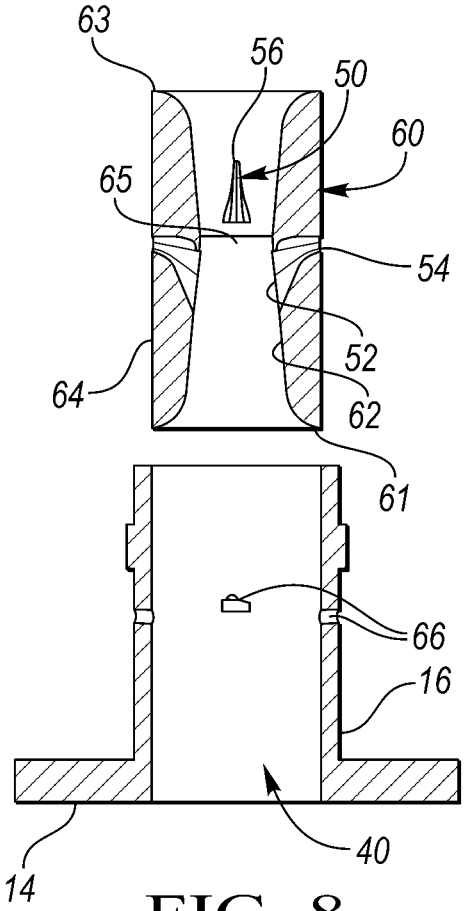
FIG. 8 is a cross-sectional view of the unassembled pole piece and insert member of FIG. 7.
Figure 9:
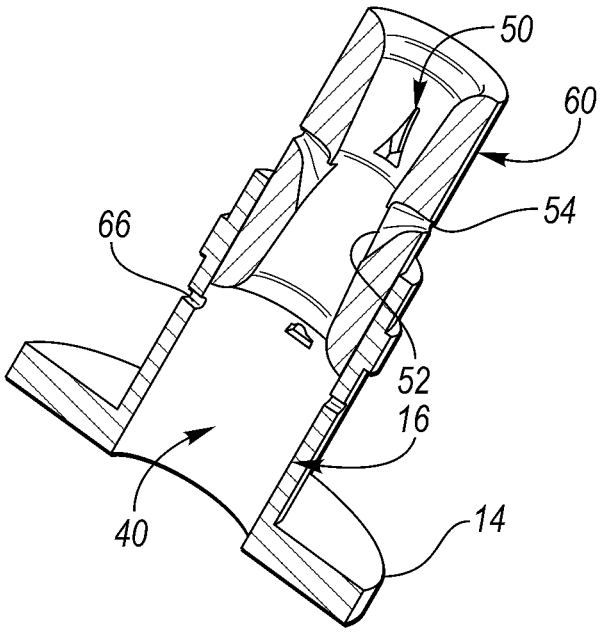
FIG. 9 is a perspective, cross-sectional view of the insert member partially inserted into the pole center vent.
Figure 10:
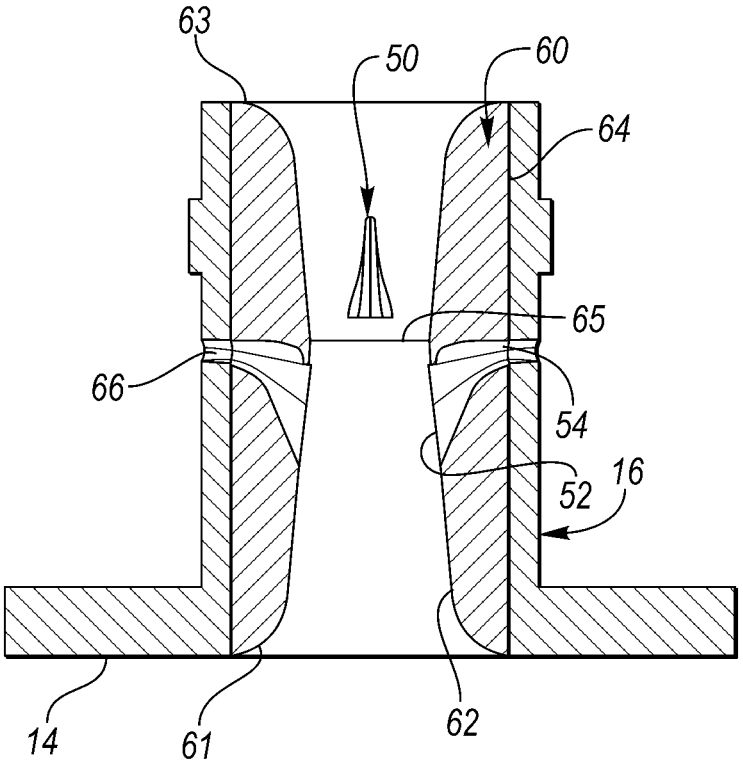
FIG. 10 is a cross-sectional view of the insert member fully inserted into the pole piece.

FIGS. 7 and 8 illustrate perspective and cross-sectional views, respectively, of the insert member 60 prior to insertion into the center vent 40 of the pole piece 16, while FIG. 9 depicts the insert member 60 in a state of partial insertion into the pole piece 16. Once inserted, as shown in the cross-sectional view of FIG. 10, the insert member 60 may be coupled to the pole piece 16, such as by a mechanical attachment or adhesive. As illustrated, the pole piece 16 includes apertures 66 with a configuration designed to align with the duct outlets 54 formed in the insert member 60 when the insert member 60 is substantially received within the center vent 40. Therefore, the duct inlet 52 is located at the interior surface 62 of the insert member 60 and the duct outlet 54 is located at the exterior surface 64 of the insert member 60, wherein alignment of the duct outlet 52 with the an aperture 66 of the pole piece 16 allows for fluid communication between insert member 60 and the air gap 22 to extract air flow from the insert member 60 and redirect the air flow toward the voice coil 26. In this way, the pole piece 16 need not include the intricate vent shapes, and thus be manufactured more simply and for a lesser cost. As described above with reference to FIGS. 1-6, one or more ducts 50 can be used in the insert member 60 depending on the application and how much air flow or cooling is desired. The ducts 50 may all be oriented in the same direction, or may be oriented in alternating, opposite or mirror image directions (i.e., rotated 180 degrees) relative to one another with some ducts 50 oriented with fronts 56 towards the insert member first end 61, and some ducts 50 oriented in the opposite direction with fronts 56 towards the insert member second end 63. In addition, the ducts 50 may be disposed at different positions along the length of the insert member 60.

Figure 11:
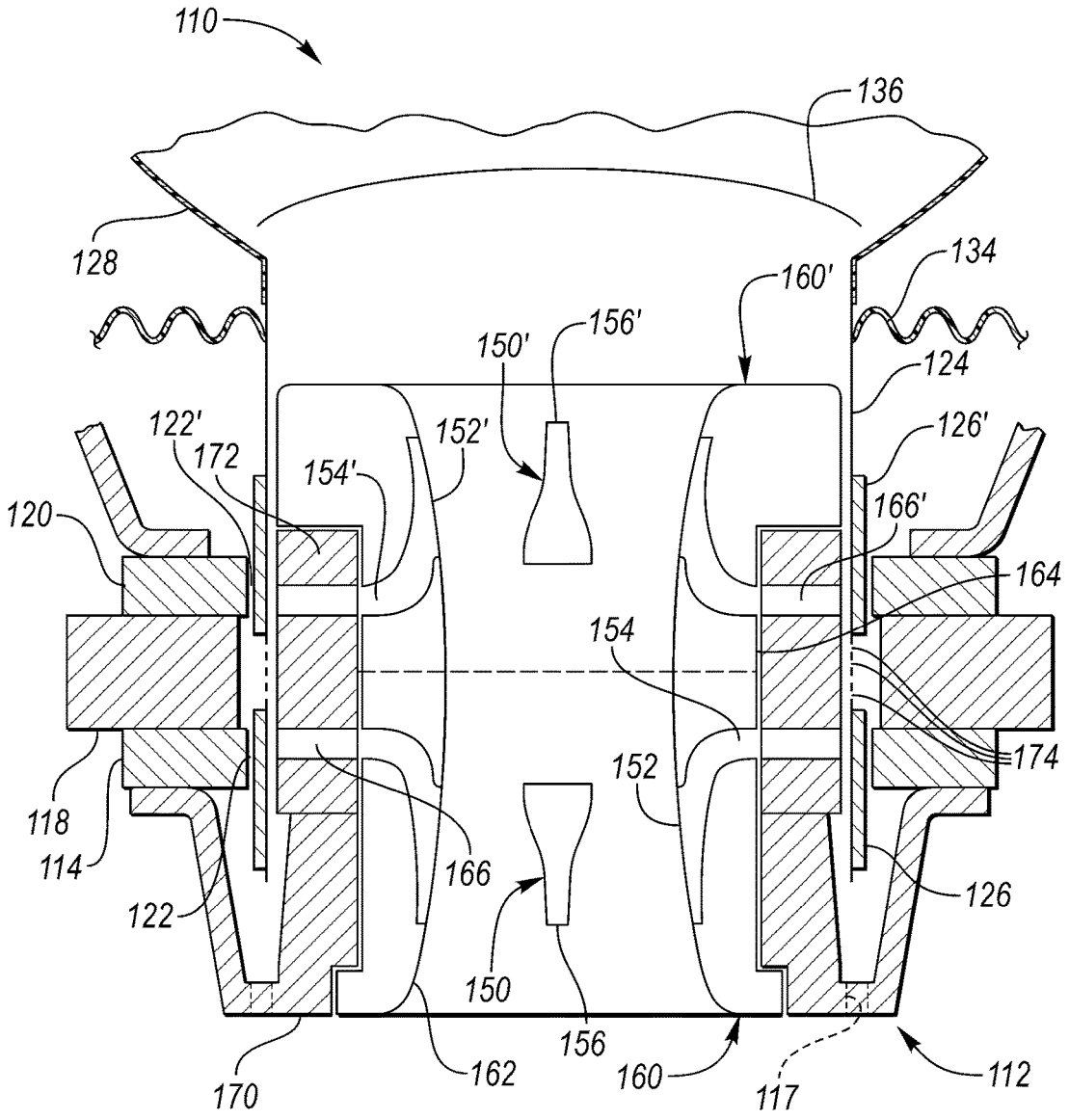
FIG. 11 is a cross-sectional view of a loudspeaker according to an embodiment having dual air gap design with pole ducts.

Turning to FIG. 11, duct cooling of the voice coil is not limited to single magnetic gap motor designs as described above, but may also be employed in a loudspeaker 110 with a dual magnetic air gap motor design. In a dual gap motor design, the motor assembly 112 includes spaced upper 120 and lower steel plates 114 with a magnet 118 disposed therebetween, a motor support housing 170 supports the lower plate 114 and a motor inner steel sleeve 172, and a frame 132 abuts the upper plate 120. First 122 and second 122' magnetic air gaps of opposite polarity are defined by the inner sleeve 172 on one side and by the upper plate 120, lower plate 114 and magnet 118 on another side, which then drive a first voice coil 126 disposed in the first air gap 122 and a spaced, second voice coil 126' disposed in the second air gap 122'. The two voice coils 126, 126' are separated from each other and are attached to a common center voice coil former 124 that drives the transducer diaphragm 128.

At least one hollow insert member 160 including ducts 150 (e.g., NACA ducts) formed therein is arranged to be received by the motor support housing 170 to allow bi-directional air flow in and out of the motor assembly 112. As with the embodiment of FIGS. 7-10 described above, each duct 150 has an inlet 152 located at an interior surface 162 of the insert member 160 and an outlet 154 located at an exterior surface 164 of the insert member 160. In the embodiment depicted in FIG. 11, two insert members 160, 160' are utilized, each having a plurality of ducts 150, 150' (e.g., 4 symmetrically spaced ducts as shown). The duct outlets 154, 154' may be positioned adjacent channels 166, 166' formed in the inner sleeve 172, therefore allowing for fluid communication between the insert members 160, 160' and the first and second air gaps 122, 122' as a result of diaphragm 128/dome 136 motion to extract air flow from the insert members 160, 160' and redirect the air flow toward the first and second voice coils 126, 126' in the manner described above for the embodiments of FIGS. 1-10. As shown, the voice coil former 124 may have perforations 174 in the area between the voice coils 126, 126' to offer cooling air exchange from the inside diameter of the voice coil 126, 126' to the outside diameter of the voice coil 126, 126'.

The configuration of ducts 150, 150' illustrated in FIG. 11 comprises four equally spaced NACA ducts 150 in the upper insert 160 each having a first orientation and in fluid communication with the first air gap 122, and four equally spaced NACA ducts 150' in the lower insert 160' each having a second, opposite orientation compared with those of the upper insert 160 and in fluid communication with the second air gap 122'. In this manner, convective cooling is provided on both forward diaphragm 128/dome 136 displacement and on rearward diaphragm 128/dome 136 displacement. Of course, as described for embodiments above, various modifications to the number, placement and orientation of ducts 150, 150', as well as the geometry of the insert interior surface 164 are also applicable to this dual magnetic air gap embodiment. Also, as above, in one embodiment, holes 117 may be provided in the motor support housing 170 to allow hot air within the magnetic air gap 122, 122' to escape and be exchanged with outside air, offering additional cooling.

With continuing reference to FIG. 11, duct cooling may also be applied to an embodiment similar to the dual gap motor geometry illustrated therein, but in this embodiment the upper plate 120, lower plate 114, and magnet 118 would be mounted to the motor support housing 170 on an inner diameter of the voice coil former 124. The inner sleeve 172 would then be mounted to the motor support housing 170 on the outside of voice coils 126, 126', and thus be identified as the "outer" sleeve. In this example, the magnetic air gaps 122, 122' are still formed by the close proximity of the upper 120 and lower 114 steel plates and the now "outer" sleeve 172. Similar insert members 160, 160' could still be used in this embodiment, however, now the channels 166, 166' would be positioned to travel through a portion of the upper 120 and lower 114 steel plates, and/or possibly the magnet 118 as well.

Loudspeaker systems utilizing the duct embodiments described herein may benefit from higher power handling and power ratings due to improved convective cooling of internal components.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A loudspeaker, comprising:

a motor assembly including a back plate, a pole piece centrally disposed with respect to the back plate, the pole piece having a first end and a second end, the pole piece having a center vent allowing bi-directional air flow in and out of the motor assembly, a top plate concentrically disposed with respect to the pole piece, and a magnet disposed between the back plate and the top plate, wherein a magnetic air gap is defined between the pole piece and the top plate; and a voice coil disposed in the magnetic air gap;

wherein the pole piece includes at least one NACA duct formed therein, the at least one NACA duct having an inlet located at an internal surface of the pole piece in fluid communication with the center vent and an outlet located at an exterior surface of the pole piece in fluid communication with the air gap in order to extract air flow from the center vent and redirect the air flow toward the voice coil.

2. The loudspeaker of claim 1, wherein the at least one NACA duct includes a diametrically opposed first pair and a diametrically opposed second pair of NACA ducts.

3. The loudspeaker of claim 2, wherein the first and second pairs of NACA ducts are equally spaced from the pole piece first end and the pole piece second end.

4. The loudspeaker of claim 2, wherein the first and second pairs of NACA ducts are all oriented in the same direction.

5. The loudspeaker of claim 2, wherein the first pair of NACA ducts is oriented with fronts towards the pole piece first end, and the second pair of NACA ducts is oriented in the opposite direction with fronts towards the pole piece second end.

6. The loudspeaker of claim 2, wherein the first pair of NACA ducts is positioned so that the duct outlets are at an upper portion of the voice coil above the magnetic air gap, and the second pair of NACA ducts is positioned so that the duct outlets are at a lower portion of the voice coil below the magnetic air gap.

7. The loudspeaker of claim 1, wherein the center vent has a uniform diameter along a length of the pole piece.

8. The loudspeaker of claim 1, wherein the center vent diverges from a central portion of the pole piece such that the center vent has a greater diameter at the pole piece first end and the pole piece second end compared with a diameter of the center vent at the central portion of the pole piece.

9. A loudspeaker, comprising:

a motor assembly including a back plate, a pole piece centrally disposed with respect to the back plate, the pole piece having a first end and a second end, the pole piece having a center vent and having at least one radial aperture formed therein, a top plate concentrically disposed with respect to the pole piece, and a magnet disposed between the back plate and the top plate, wherein a magnetic air gap is defined between the pole piece and the top plate;

a voice coil disposed in the magnetic air gap; and a hollow insert member arranged to be received within the center vent and allowing bi-directional air flow in and out of the motor assembly, the insert member having a first end and a second end, the insert member including at least one duct formed therein having an inlet located at an interior surface of the insert member and an outlet located at an exterior surface of the insert member, wherein alignment of the duct outlet with the at least one aperture of the pole piece allows for fluid communication between insert member and the air gap to extract air flow from the insert member and redirect the air flow toward the voice coil.

10. The loudspeaker of claim 9, wherein the insert member is constructed from a non-ferrous material.

11. The loudspeaker of claim 9, wherein the at least one duct comprises a NACA duct.

12. The loudspeaker of claim 11, wherein the at least one NACA duct includes a diametrically opposed first pair and a diametrically opposed second pair of NACA ducts.

13. The loudspeaker of claim 12, wherein the first and second pairs of NACA ducts are all oriented in the same direction.

14. The loudspeaker of claim 12, wherein the first pair of NACA ducts is oriented with fronts towards the insert member first end, and the second pair of NACA ducts is oriented in the opposite direction with fronts towards the insert member second end.

15. The loudspeaker of claim 9, wherein the insert member interior surface has a uniform diameter along a length of the insert member.

16. The loudspeaker of claim 9, wherein the insert member interior surface diverges from a central portion of the insert member such that the insert member interior surface has a greater diameter at the insert member first end and the insert member second end compared with a diameter of the insert member interior surface at the central portion of the insert member.

17. The loudspeaker of claim 9, wherein the insert member is coupled to the pole piece once inserted.

18. A loudspeaker, comprising:

a motor assembly including spaced upper and lower plates with a magnet disposed therebetween, a motor support housing supporting the lower plate, and an inner sleeve supported by the motor support housing, the inner sleeve having channels formed therein, wherein first and second magnetic air gaps of opposite polarity are defined by the inner sleeve on one side and by the upper plate and the lower plate on another side;

a first voice coil disposed in the first magnetic air gap;

a second voice coil disposed in the second magnetic air gap and spaced from the first voice coil; and at least one hollow insert member arranged to be received by the motor support housing and allowing bi-directional air flow in and out of the motor assembly, the at least one insert member including NACA ducts formed therein each having an inlet located at an interior surface of the insert member and an outlet located at an exterior surface of the insert member, wherein alignment of the duct outlets with the channels of the inner sleeve allows for fluid communication between the insert member and the first and second air gaps to extract air flow from the insert member and redirect the air flow toward the first and second voice coils.

19. The loudspeaker of claim 18, wherein the at least one insert member has NACA ducts with a first orientation in fluid communication with the first air gap, and NACA ducts with a second, opposite orientation in fluid communication with the second air gap.

20. The loudspeaker of claim 18, wherein the voice coils are attached to a common voice coil former, the voice coil former including perforations in an area between the voice coils.

* * * * *